United States Patent [19]

Lang

[11] 4,375,326

[45] Mar. 1, 1983

[54] DUPLEX REPRODUCING MACHINE

[75] Inventor: Joseph H. Lang, Webster, N.Y.

[73] Assignee: Xerox Corporation, Stamford, Conn.

[21] Appl. No.: 271,738

[22] Filed: Jun. 8, 1981

[51] Int. Cl.[3] ..... G03G 15/00

[52] U.S. Cl. ..... 355/3 SH; 355/3 R; 355/14 SH

[58] Field of Search ..... 355/3 R, 14 R, 14 SH, 355/3 SH, 24; 271/271, 154

[56] References Cited

U.S. PATENT DOCUMENTS 3,980,406 9/1976 Lang ..... 355/24

4,190,354 2/1980 Smith et al. ..... 355/24 X 4,272,180 6/1981 Satomi et al. ..... 355/24 X 4,305,655 12/1981 Gamblin et al. ..... 355/24

*Primary Examiner*—A. C. Prescott

[57] ABSTRACT

A reproducing machine in which successive images are formed on opposed sides of a copy sheet to produce a duplex copy. The copy sheet is inverted after an image is transferred to one side thereof at a first transfer zone. A second transfer zone receives the inverted sheet and transfers an image to the other side of the copy sheet. Thereafter, both images are permanently affixed to the copy sheet.

8 Claims, 5 Drawing Figures

DUPLEX REPRODUCING MACHINE

The present invention relates generally to an electrophotographic printing machine, and more particularly concerns an apparatus for handling the copy sheet to provide transfer of successive powder images to opposed sides thereof so as to produce a duplex copy.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, a developer mixture is brought into contact therewith. This forms a powder image on the photoconductive member which is subsequently transferred to a copy sheet. Finally, the copy sheet is heated to permanently affix the powder image thereto in image configuration.

As electrophotographic printing machines increase in speed and become highly automated, the printing machine must be capable of not only producing simplex copies, i.e. copies having information on only one side thereof, but they must also be capable of producing duplex copies, i.e. copies having information on both sides thereof. Hereinbefore, electrophotographic printing machines have produced duplex copies by first transferring one powder image to one side of the copy sheet and fusing this image thereto. Thereafter, the next powder image is transferred to the other side of the copy sheet and the copy sheet once again undergoes the fusing process. Various embodiments of duplex copying techniques are disclosed in U.S. Pat. No. 3,672,765 issued to Altmann in 1972; U.S. Pat. No. 4,098,551 issued to Komori et al. in 1978; U.S. Pat. No. 4,123,155 issued to Hubert in 1978; U.S. Pat. No. 4,191,465 issued to Boase et al. in 1980; U.S. Pat. No. 4,194,829 issued to Cavagnaro in 1980; U.S. Pat. No. 4,212,529 issued to O'Brien et al. in 1980 and Research Disclosure Journal, December 1979, No. 18814, pages 679–681. The art has also developed a variety of devices capable of inverting sheets as exemplified by those set forth in U.S. Pat. No. 3,227,444 issued to Egan in 1966; U.S. Pat. No. 3,408,140 issued to Hemphill in 1968; U.S. Pat. No. 3,641,931 issued to Hickox et al. in 1972 and U.S. Pat. No. 3,862,802 issued to Till in 1975. In duplex copying, it is highly desirable to invert the sheet in a rapid manner without disturbing the unfused toner powder image. The following disclosures appear to be relevant:

U.S. Pat. No. 4,110,025
Patentee: Tabata
Issued: Aug. 29, 1978
Research Disclosure Journal
September 1979
No. 18546, Page 501
Author: DiFrancesco
Xerox Disclosure Journal
Vol. 5, No. 6
November/December 1980, page 633
Author: R. E. Smith The pertinent portions of the foregoing disclosures may be briefly summarized as follows:

Tabata discloses a copying machine in which chains move a copy sheet from a transfer station through a fushing station to fix the toner powder image to one side thereof. The copy sheet is then fed onto a tiltable table. The trailing edge of the sheet is then gripped by chain clamps and the opposed side of the sheet moved into contact with photoconductive drum at the transfer station. A toner powder image is transferred to the other side of the sheet. The sheet then passes through the fusing station to fix this toner powder image to the sheet. The table pivots to horizontal position to receive the finished copy sheet.

DiFrancesco describes an electrophotographic printing technique for producing duplex copies. A first toner image is transferred to the copy sheet at a first transfer station. The copy sheet moves with the photoconductive member to a diverter which deflects the copy sheet onto a reversible vacuum transport. The vacuum transport reverses direction to move the other side of the copy sheet into contact with the photoconductive belt. The photoconductive belt advances the sheet to a second transfer station where the second toner powder image is transferred to the sheet. The copy sheet is then separated from the photoconductive belt and proceeds to an image fixing device.

Smith discloses a copy system for both simplex and duplex copying of an original document. In duplex copying, the document is stripped from the photoreceptor by a vacuum transport/duplex inverter. After the document is inverted, it is transported to the photoreceptor which carries it through a second transfer station to the fuser.

In accordance with one aspect of the features of the present invention, there is provided a reproducing machine for forming successive images on opposed sides of a copy sheet to produce a duplex copy. A movable member is arranged to have a first image and a second image recorded thereon. The member moves from a first transfer zone to a second transfer zone. Means are provided for receiving the copy sheet. Means advance the copy sheet from the receiving means. Means move the receiving means from a position remote from the advancing means for receiving the copy sheet after transferring the image from the member to one side thereof at a first transfer zone to a position in operative association with the advancing means for advancing the copy sheet from the receiving means to the second transfer zone for transferring the second image from the member to the other side of the copy sheet.

Pursuant to another aspect of the features of the present invention, there is provided a method of reproducing in which successive images are formed on opposed sides of a copy sheet to produce a duplex copy. The method of reproducing includes the steps of transferring a first image from a member to one side of a copy sheet at a first transfer zone, and advancing the copy sheet onto a receiving member after the first image has been transferred to one side thereof. The receiving member moves from a position remote from a copy sheet feeder to a position in operative communication therewith. Actuation of the copy sheet feeder advances the sheet from the receiving member to a second transfer zone where a second image is tranferred from the member to the other side of the copy sheet.

Other aspects of the present invention will become apparent as the following description proceeds and upon reference to the drawings, in which.

While the present invention will hereinafter be described in connection with a preferred embodiment and method of use thereof, it will be understood that it is not intended to limit the invention to the embodiment or method of use. On the contrary, it is intended to cover all alternatives, modifications and equivalents as may be included within the spirit and scope of the invention as defined by the appended claims.

Figure 1:
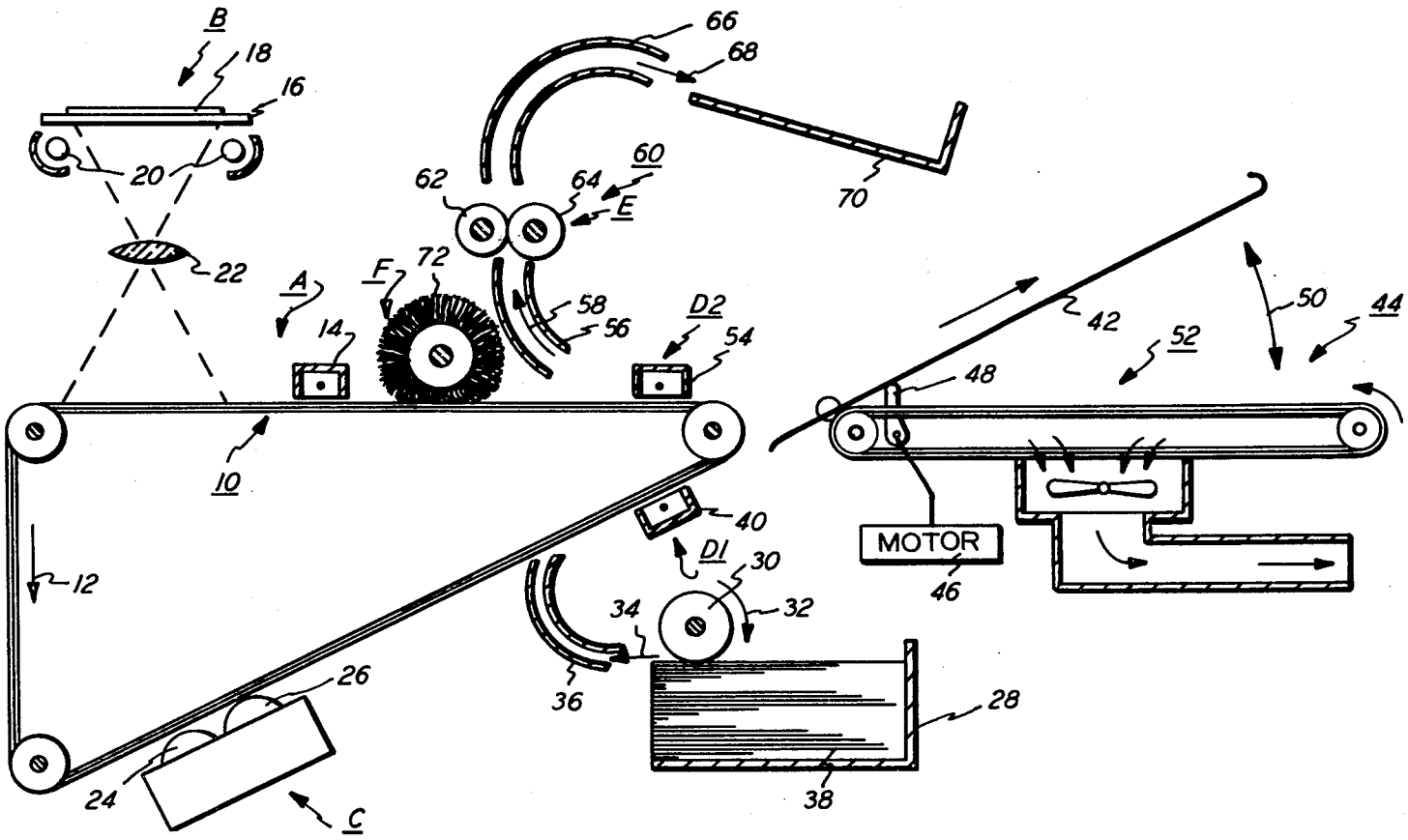
FIG. 1 is a schematic elevational view depicting an electrophotographic printing machine incorporating the features of the present invention therein.

For a general understanding of the features of the present invention reference is had to the drawings. In the drawings, like reference numerals have been used throughout to identify identical elements. FIG. 1 schematically depicts the various components of an electrophotographic printing machine incorporating the sheet inverting and duplexing system of the present invention therein. It will become apparent from the following discussion that the sheet inverting and duplexing system is equally well suited for use in a wide variety of electrophotographic printing machines and is not necessarily limited in its application to the particular embodiment or method of use described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface disposed on a conductive substrate. Preferably the photoconductive surface comprises a selenium alloy with the conductive substrate being made from an aluminum alloy. Belt 10 moves in the direction of arrow 12 to advance successive portions of the photoconductive surface sequentially through the various processing stations disposed about the path of movement thereof.

Initially, a portion of th photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced to imaging station B. Imaging station B includes a transparent platen 16 having original document 18 disposed facedown thereon. Lamps 20 illuminate the original document on transparent platen 16. The light rays reflected from original document 18 are transmitted through lens 22. Lens 22 forms a light image of the original document which is focused onto the charged portion of the photoconductive surface of belt 10 to selectively dissipate the charge thereon. This records an electrostatic latent image on the photoconductive surface which corresponds to the informational areas contained within original document 18.

After imaging, belt 10 advances the electrostatic latent image recorded on the photoconductive surface to development station C. At development station C, a pair of magnetic brush developer rollers 24 and 26 advance developer material into contact with the electrostatic latent image. Toner particles are attracted from the carrier granules to the latent image on the photoconductive surface in image configuration. Belt 10 then advances the powder image to transfer station D1.

At transfer station D1, a copy sheet is moved into contact with the powder image recorded on the photoconductive surface of belt 10. Copy sheets are fed from tray 28. Feed roller 30 rotates in the direction of arrow 32 to advance copy sheets in the direction of arrow 34 into chute 36. In this way, successive copy sheets are advanced from stack 38 into chute 36. Chute 36 guides the copy sheet into contact with the powder image deposited on the photoconductive surface of belt 10 at transfer station D1. At transfer station D1, a corona generating device 40 sprays ions onto the back side of the copy sheet. This attracts the toner powder image from the photoconductive surface of belt 10 to the copy sheet. After transfer, belt 10 advances the copy sheet onto tray 42 of the sheet inverter, indicated generally by the reference numeral 44. At this time, motor 46 rotates cam 48 so as to pivot tray 42 in a downward direction as indicated by arrow 50 into operative association with vacuum transport 52. During this time, the next successive powder image is being formed on the photoconductive surface of belt 10. This powder image corresonds to the informational areas contained within another original document or, the information contained on the other side of document 18. The copy sheet disposed on tray 42 has the powder image disposed face up. The timing and logic controller of the printing machine actuates vacuum transport 52 in synchronism with the advancement of the second powder image to transfer station D2. Actuation of vacuum transport 52 with tray 42 pivoted in the downwardly direction so as to dispose the copy sheet thereon advances the copy sheet into contact with the second powder image deposited on the photoconductive surface of belt 10 at transfer station D2. The copy sheet is advanced such that the trailing edge thereof moves initially into contact with the powder image deposited on the photoconductive surface of belt 10. The back side of the copy sheet now contacts the powder image, i.e. the other side so as to produce a duplex copy. At transfer station D2, a corona generating device 54 sprays ions onto the copy sheet. This attracts the second powder image from the photoconductive surface to the copy sheet. After transfering the second powder image to the copy sheet, the copy sheet advances it through chute 56 in the direction of arrow 58 to fusing station E.

Fusing station E includes a fuser assembly, indicated generally by the reference numeral 60, which permanently affixes the transferred toner powder images to both sides of the copy sheet. Preferably, fuser assembly 60 includes heated fuser rollers 62 and 64. The toner powder images contact the heated fuser rollers 62 and 64. In this manner, the powder images are permanently affixed to both sides of the copy sheet forming a duplex copy. After fusing, chute 66 guides the advancing copy sheet in the direction of arrow 68 to tray 70 for subsequent removal therefrom by the machine operator.

Invariably, after the toner powder images are transferred to the copy sheet, some residual particles remain adhering to the photoconductive surface. These residual particles are removed from the photoconductive surface at cleaning station F. Cleaning station F includes a rotatably mounted fibrous brush 72 in contact with the photoconductive surface. The particles are cleaned from the photoconductive surface by the rotation of brush 72 in contact therewith. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the duplexing features of the present invention therein.

Figure 2:
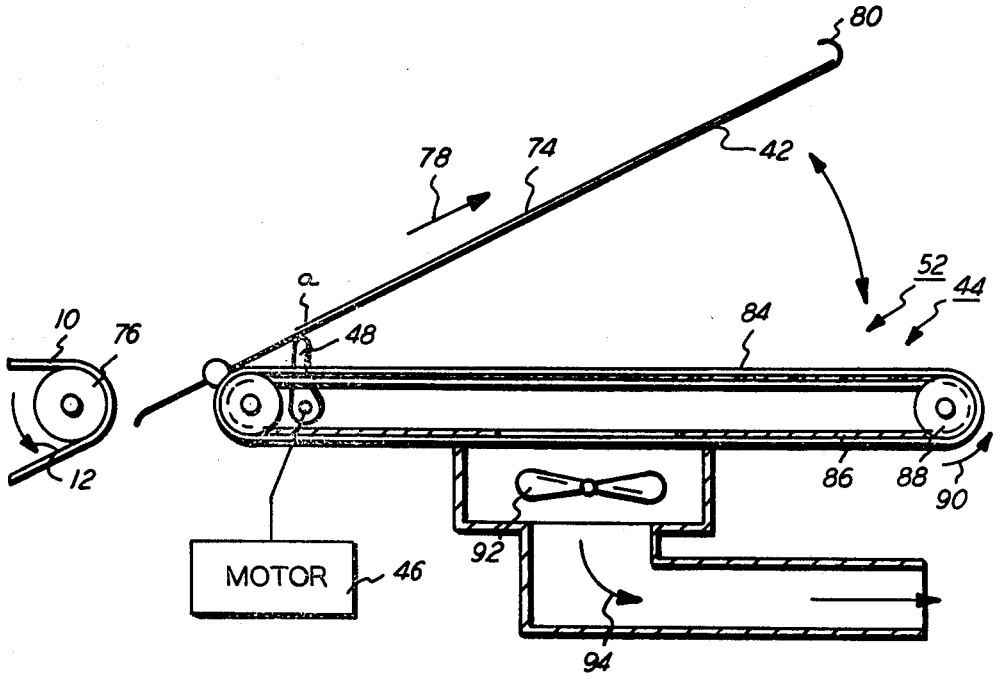
FIG. 2 is a fragmentary elevational view showing the sheet inverter receiving the copy sheet from the first transfer zone.
Figure 3:
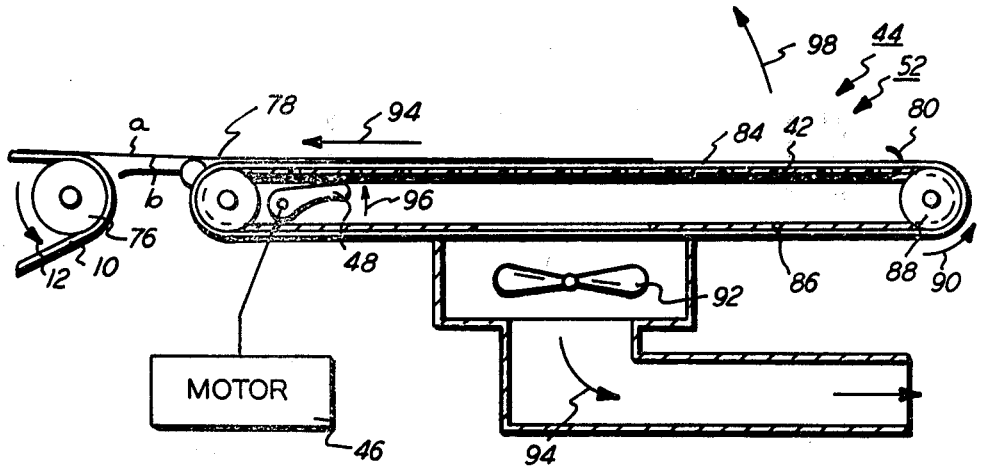
FIG. 3 is a fragmentary elevational view illustrating the FIG. 2 sheet inverter returning the copy sheet to the second transfer zone.

Referring now to the specific subject matter of the present invention, the general operation of sheet inverter 44 is depicted in FIG. 2 in the sheet receiving mode and in FIG. 3 in the sheet advancing mode. Turning initially to FIG. 2, after copy sheet 74 has the toner powder image transferred to side A, the sheet advances with belt 10. Inasmuch as belt 10 is entrained about roller 76 with the angle between the portion of belt 10 advancing onto roller 76 and the portion leaving roller 76 being an acute angle, the beam strength of sheet 74 strips the sheet from belt 10. Sheet 74 continues to advance in the direction of arrow 78 onto plate 42 with side A, i.e. the side having the first toner powder image deposited thereon face up. Tray 42 defines a generally planar surface for receiving sheet 74 with the plane being substantially in the plane defined by the first transfer zone of transfer station D1. Thus, sheet 74 continues to move from belt 10 in a substantially straight line onto tray 42 with the beam strength of sheet 74 separating it from belt 10. The lead edge of sheet 74 engages rear guide 80 of plate 42. After sheet 74 is positioned on tray 42, indexing motor 46 rotates cam 48 so that tray 80 pivots in the direction of arrow 82. In this way, sheet 74 is disposed on belts 84 of vacuum transport 52. Vacuum transport 52 includes a vacuum plenum 86 supporting rollers 88 having belts 84 entrained thereabout. A plurality of spaced belts 84 are disposed about rollers 88. One of the rollers 88 is driven by a motor (not shown) so as to advance belts 84 in the direction of arrow 90. Spaced belts 84 are porous. Vacuum plenum 86 is recessed beneath belts 84. Plate 42 is adapted to be interposed between adjacent belts 84 so that plate 42 rests beneath belts 84 on plenum 86 with copy sheet 74 resting on belts 84. Blower 92 draws air in the direction of arrow 94 so as to reduce the pressure in plenum 86 securing copy sheet 74 to belts 84. FIG. 3 depicts copy sheet 74 on belts 84 with the tray 42 resting on plenum 86.

Referring now to FIG. 3, tray 42 rests on plenum 86 with sheet 74 resting on belts 84. Belts 84 define a plane which includes the second transfer zone at transfer station D2. Thus, belt 10, after leaving roller 76, is in the plane defined by belts 84. Actuation of vacuum transport 52 causes belts 84 to advance in the direction of arrow 90. This causes sheet 74 to advance in the direction of arrow 94. In this way, side B of sheet 74 moves into contact with the powder image deposited on photoconductive surface of belt 10 at the second transfer zone. This transfer zone is located at transfer station D2. It should be noted that the electrostatic attractive force between belt 10 and sheet 78 prevents slippage therebetween. The trailing edge of sheet 74 initially moves into the second transfer zone at transfer station D2. At this time, the second toner powder image is transferred to side B of copy sheet 74 producing a duplex copy. Vacuum blower 92 is de-energized to permit the release of sheet 74 from belts 84. After copy sheet 74 has advanced from belts 84, motor 46 is actuated pivoting cam 48 in the direction of arrow 96 so as to pivot tray 42 away from plenum 86 in the direction of arrow 98 to the remote position for receiving the next successive copy sheet with the toner powder image transferred to the first side thereof.

Figure 4:
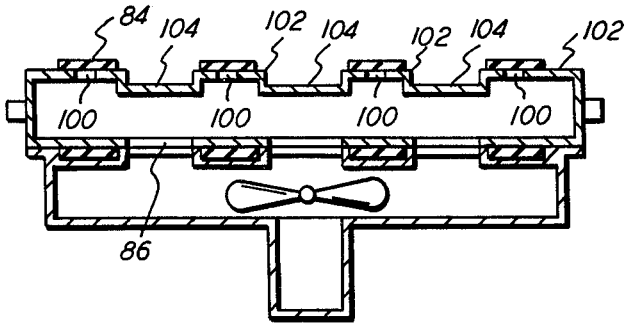
FIG. 4 is a fragmentary, sectional elevational view depicting the vacuum transport of the FIG. 2 inverter.

Referring now to FIG. 4, there is shown the detailed structure of vacuum plenum 86 and belts 84. Preferably, belts 84 are made from an air porous material. Plenum 86 includes a plurality of spaced slots 100. Slots 100 are located in raised portions 102 of plenum 86. Raised portions 102 support belts 84 thereon. Recessed portions 104 are adapted to receive plate 42. In this way, copy sheet 74 rests on porous belts 84 while plate 42 rests in recessed portions 104. Thus, copy sheet 74 is spaced from the tray and moves with belts 84.

Figure 5:
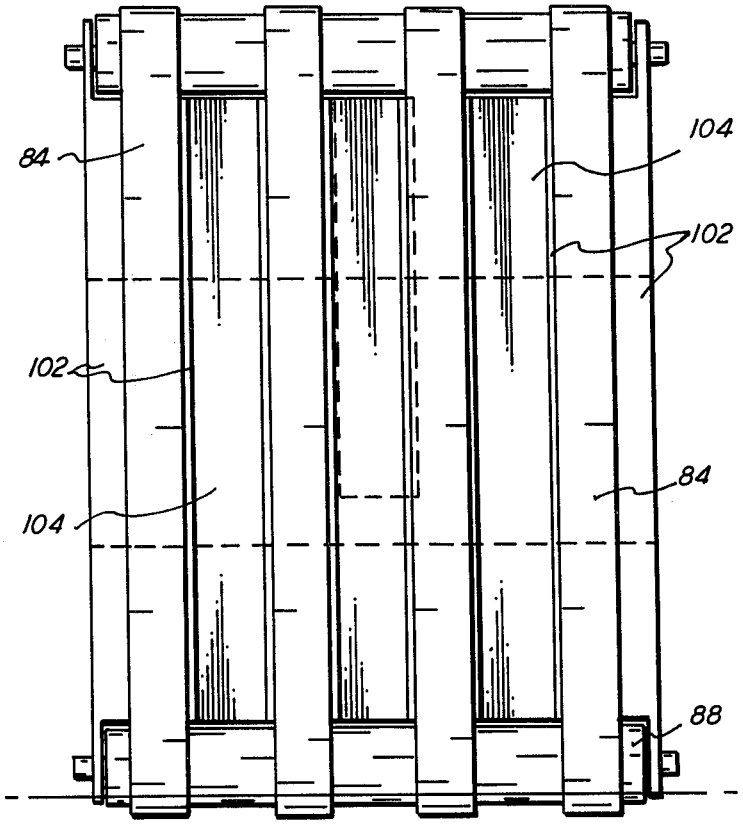
FIG. 5 is a partial plan view showing the vacuum belts of the FIG. 4 vacuum transport.

Referring now to FIG. 5, there is shown a plan view of belts 84. As depicted thereat, belts 84 are supported on the raised portions 102 of plenum 86 with slots 100 being disposed therebeneath. Recessed portions 104 of vacuum plenum 86 are located in the space between adjacent belts 84. In this way, tray 42 may be readily positioned between belts 84 in recessed portions 104 of plenum 86. Thus, copy sheet 74 now rests on belts 84. Inasmuch as belts 84 are porous and cover slots 100, the airflow secures copy sheet 74 to belts 84 for movement in unison therewith.

In recapitulation, it is clear that the electrophotographic printing machine of the present invention includes a sheet inverter which receives the copy sheet after a toner powder image has been transferred to one side thereof and advances the tone powder image to a second transfer station so that the next successive toner powder image may be transferred to the other side of the copy sheet. In this way, duplex copy sheets are produced. The present invention requires the rapid articulation of a light movable tray in synchronism with the movement of successive toner powder images deposited on a photoconductive belt. Since this tray is made from a lightweight material such as a sheet metal or plastic, the movement thereof may be rapid facilitating high copy rates in the printing machine.

It is, therefore, evident that there has been provided in accordance with the present invention an electrophotographic printing machine having a sheet inverter for duplex copying which fully satisfies the aims and advantages hereinbefore set forth. While this invention has been described in conjunction with a specific embodiment thereof, it is evident that may alternatives, modifications and variations will be apparent to those skilled in the art. Accordingly, it is intended to embrace all such alternatives, modifications, and variations as fall within the spirit and broad scope of the appended claims.

What is claimed is:

1. A reproducing machine for forming successive images on opposed sides of a copy sheet to produce a duplex copy comprising:

a member arranged to have a first image and a second image recorded thereon, said member driven to move through a first plane through a first transfer zone and then change direction to move through a second plane through a second transfer zone;

a tray pivotably mounted near said member and having a surface for receiving said copy sheet;

drive means for moving said copy sheet away from said tray along said second plane; said drive means having a number of spaced belts moving in said second plane to engage said copy sheet; and means for pivoting said tray to a first position where said surface is co-incident with said first plane for receipt of a copy sheet as said member moves said sheet past the first transfer zone and away from said member as said member changes directions, said means for pivoting also operative to pivot said tray to a second position where said copy sheet engages said spaced belts thereby advancing said sheet through said second plane to said member and said second transfer zone.

2. A machine according to claim 1, wherein said advancing means includes a vacuum transport.

3. A machine according to claim 2, wherein said vacuum transport includes:

a vacuum plenum having a plurality of spaced apertures therein; and a plurality of space parallel substantially porous belts entrained about said plenum and covering the apertures therein.

4. A machine according to claim 3, wherein said member includes a photoconductive belt defining a first plane in the first transfer zone and a second plane in the second transfer zone.

5. A machine according to claim 4, wherein said photoconductive belt is entrained about a roller to form a bend therein with the first transfer zone being on one side of the bend and the second transfer zone being on the other side of the bend so that the copy sheet moves with said photoconductive belt from the first transfer zone toward the bend where the copy sheet separates from said photoconductive belt and moves onto said tray.

6. A machine according to claim 5, wherein said moving means includes:

a cam mounted rotatably on said vacuum plenum and having a surface thereof engaging said tray; and means for rotating said cam to move said tray from the remote position to a position beneath said porous belts placing the copy sheet in engagement with said porous belts so that said porous belts move the copy sheet into contact with the photoconductive belt at the second transfer zone.

7. A machine according to claim 6, wherein the first image transferred to one side of the copy sheet is a first powder image and the second image transferred to the other side of the copy sheet is a second powder image.

8. A machine according to claim 7, further including means for simultaneously fusing the first powder image and the second powder image to the copy sheet.

* * * * *